US008203497B2

(12) United States Patent
Sabban

(10) Patent No.: US 8,203,497 B2
(45) Date of Patent: Jun. 19, 2012

(54) DUAL POLARIZED DIPOLE WEARABLE ANTENNA

(75) Inventor: Albert Sabban, Kiryat Yam (IL)

(73) Assignee: Given Imaging Ltd., Yoqneam (IL)

( * ) Notice: Subject to any disclaimer, the term of this patent is extended or adjusted under 35 U.S.C. 154(b) by 387 days.

(21) Appl. No.: 12/629,299

(22) Filed: Dec. 2, 2009

(65) Prior Publication Data

US 2011/0128198 A1 Jun. 2, 2011

(51) Int. Cl.
*H01Q 1/12* (2006.01)

(52) U.S. Cl. ..... 343/718; 343/700 MS; 343/767

(58) Field of Classification Search ..... 343/718, 343/700 MS, 767, 768, 771
See application file for complete search history.

(56) References Cited

U.S. PATENT DOCUMENTS

| | | | | |
|---|---|---|---|---|
| 6,879,296 | B2 * | 4/2005 | Jiang et al. | 343/767 |
| 7,064,712 | B2 * | 6/2006 | Munk | 343/700 MS |
| 7,710,325 | B2 * | 5/2010 | Cheng | 343/700 MS |

OTHER PUBLICATIONS

A. Sabban, "Millimeter Wave Detection Arrays" APMC 2008 conference, Hong Kong, Dec. 2008 pp. 1-4.
A. Sabban, "Applications of MM Wave Microstrip Antenna Arrays" ISSSE 2007 Conference, Montreal Canada, Aug. 2007, pp. 119-122.
A. Sabban, "Ka Band Microstrip Antenna Arrays with High Efficiency", 1999 Antenna and Propagation, A&P, conference, Jul. 1999, Orlando U.S.A, pp. 2740-2743.
A. Sabban, "A Comprehensive study of losses in mm-wave microstrip antenna arrays", 1997 EuMW Conference, Jerusalem Israel, Sep. 1997, pp. 163-167.
A. Sabban,"Spectral Domain Iterative Analysis of Multilayared Microstrip Antennas", M.Sc. Thesis, Tel-Aviv University, Tel-Aviv, 1985.
A. Sabban,"A New Broadband Stacked Two Layer Microstrip Antenna", I.E.E.E Antenna and Propagation Symp., Houston, Texas, U.S.A, Jun. 1983, pp. 63-66.

* cited by examiner

*Primary Examiner* — Dieu H Duong
(74) *Attorney, Agent, or Firm* — Pearl Cohen Zedek Latzer, LLP

(57) ABSTRACT

A dual polarized dipole wearable antenna may be embedded within a shirt or/and outfit, placed at a range of up to few millimeters from the body of a user in which there is a transmitting swallowable imaging device. The antenna is constructed of three conducting layers: radiating layer, feed network layer and ground layer, separated by two dielectric substrate layers. The feed network layer may receive and transmit horizontally polarized signals. When placed one on top of the other, parallel strips of the radiating layer are disposed against a longitudinal strip of the feed network layer, and stubs of the feed network layer are disposed across a slot of the radiating layer. The slot of the radiating layer may be excited by radiation from, and be in interaction with the stubs of the feed network layer to receive and transmit vertically polarized signals.

12 Claims, 14 Drawing Sheets

DUAL POLARIZED DIPOLE WEARABLE ANTENNA

FIELD OF THE INVENTION

The present invention generally relates to a wearable antenna adapted for transmitting and receiving a radio frequency (RF) signal.

BACKGROUND OF THE INVENTION

In vivo measuring and imaging systems have been disclosed for transmitting data indicative of in-vivo measurements for medical diagnosis and other purposes. Typically, such measuring and imaging systems include an ingestible capsule for capturing data within the body of a patient and transmitting the captured data outside the body to a storage device using electromagnetic radiation. The electromagnetic radiation is received by at least one antenna temporarily is placed in proximity to, or affixed to the user's body. The output of the antenna is sent to a data receiver storage device.

Currently used arrangements include an antenna belt tightly wrapped around a patient or an array of antenna elements having adhesive, which may adhere each antenna element to a point on a body. Such affixations are needed to insure good electrical coupling between the transmitting capsule and a receiving antenna. However, such affixations may be uncomfortable to the user.

There is therefore a need for a comfortable wearable antenna or a set of antennas that may efficiently receive and transmit electromagnetic signals from within the body while ensuring comfort for the user.

SUMMARY OF THE INVENTION

According to embodiments of the invention, a dual polarized dipole wearable antenna may comprise: a first dielectric substrate layer, a second dielectric substrate layer, a conductive feed network layer formed on the inner sides of said first and said second dielectric substrate layers, said feed network layer comprising a main stripe comprising a plurality of substantially straight sections parallel to each other and connected to each other via substantially right angled bands with substantially orthogonal stubs protruding from said sections, two of these stubs defining feed points for the antenna, a conductive radiating layer formed on the outer side of said first dielectric substrate layer, said radiating layer comprising two continuous and parallel stripes banded at right angles to form a plurality of substantially parallel sections said stripes having there between a rectangular slot, wherein said radiating layer is disposed along said main stripe of said feed network layer, and a conductive ground layer formed on the outer side of said second dielectric substrate layer, said ground layer extending beyond the outermost dimensions of said feed network layer and said radiating layer, wherein said stubs of said feed network layer are disposed across from said slot of said radiating layer such that said antenna is capable of receiving and transmitting both substantially vertically and substantially horizontally polarized signals.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
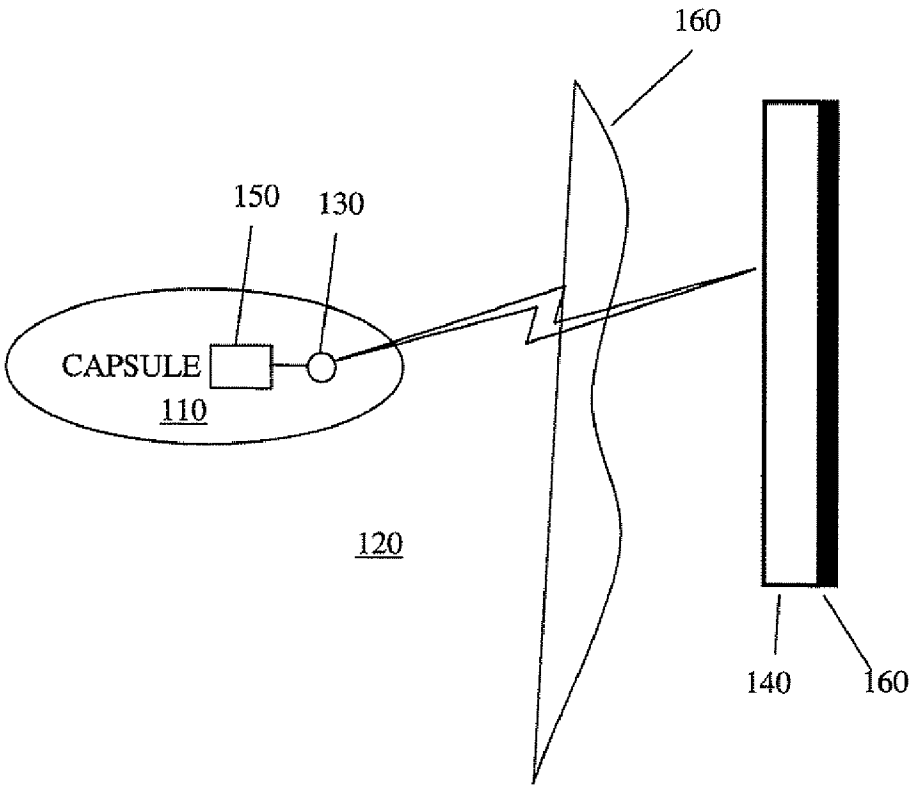
FIG. 1 is a schematic illustration of an in vivo measuring and imaging system.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Reference is now made to FIG. 1 which schematically illustrates an in vivo measuring and imaging system. Such system may include an ingestible capsule 110 for capturing data within the body of a patient and transmitting the captured data outside the body using electromagnetic signals, or RF signals. Capsule 110 may comprise a controller 150 and an internal antenna set 130. Capsule 110 may collect a series of data as it traverses a body lumen such as the GI tract. Currently available capsules may transmit data using an elliptically polarized internal loop antenna, or other suitable antennas 130. Capsule 110 may turn and change its orientation as it moves along the GI tract, thus changing the orientation of internal antenna 130 with respect to an external imaginary reference frame and as a result—with respect to an external antenna or set of antennas. The electromagnetic signals are received by an external antenna 140 that may be temporarily affixed to the body of the patient under examination. Such antenna may typically cover an area of the body corresponding to the location of the GI tract 160. Antenna 130 located within the capsule may also receive signals transmitted by external antenna 140. The output of internal antenna 130 may be sent to controller 150 located within the capsule 110. According to embodiments of the invention external antenna 140, does not necessarily has to be affixed to the body. Instead, antenna 140 may be wearable, i.e. embedded within a shirt or/and outfit, placed at a range of up to few millimeters from the body. This arrangement may be more comfortable to the patient.

It is typically required that external antenna 140 comprise a ground layer 160 located at an outer layer of external antenna 140 facing away from the patient's body. Such ground layer is known to provide noise shielding for RF signals arriving from the environment and to increase the efficiency of the antenna. The combination of noise shielding and increased efficiency contribute to the total signal to noise ratio (SNR) of the antenna.

Figure 2:
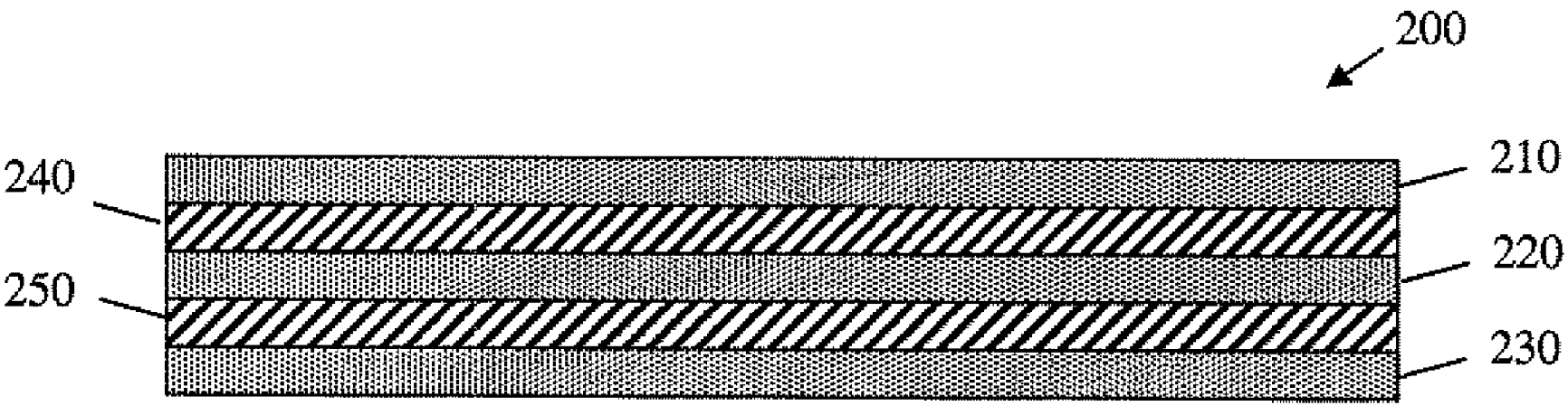
FIG. 2 is a schematic illustration of a cross-sectional view of the layers structure of a dual polarized dipole wearable antenna according to embodiments of the present invention.

Reference is now made to FIG. 2 which is a schematic illustration of a cross-sectional side view 200 of the layers structure of a dual polarized dipole wearable antenna according to embodiments of the invention. According to some embodiments of the present invention, the antenna is constructed of three conducting layers: radiating layer 210, feed network layer 220 and ground layer 230. The conducting layers may be separated by two dielectric substrate layers 240 and 250 having relative permittivity, $\in_r$ in the range of 2 to 10. Typically, the relative permittivity, $\in_r$ of dielectric substrate layer 240 is higher than the relative permittivity, $\in_r$ of dielectric substrate layer 250. For example, dielectric substrate layer 240 may be constructed from RO3035 with $\in_r$=3.5 and dielectric substrate layer 250 may be constructed from RT-Duroid 5880 dielectric substrate with $\in_r$=2.2. RO3035 and RT-Duroid 5880 are commercial substrates which may be replaced by other commercial substrates such as captor, FR4 or other dielectric materials. Ground layer 230 may be 0.5 Oz thick.

According to some embodiments of the present invention antenna 140 may receive signals in a center frequency in the range of 434±20 MHz. For example, the center frequency may substantially equal to 434 MHz. The bandwidth of the signals received by the antenna may be up to 20 MHz and above. The thickness of dielectric substrate layers 240 and 250 may be in the range of 0.2-1.6 mm. The antenna bandwidth is a function of the thickness of dielectric substrate layers 240 and 250. For example, 1.6 mm thickness for dielectric substrate layers 240 and 250 may yield bandwidth of 40 MHz around center frequency of 434 MHz. Alternatively, thinner dielectric substrate layers of for example 0.8 mm thick, may yield bandwidth of 20 MHz. An antenna made of thinner substrates may be more flexible mechanically and thus more comfortable for a user.

Figure 3B:
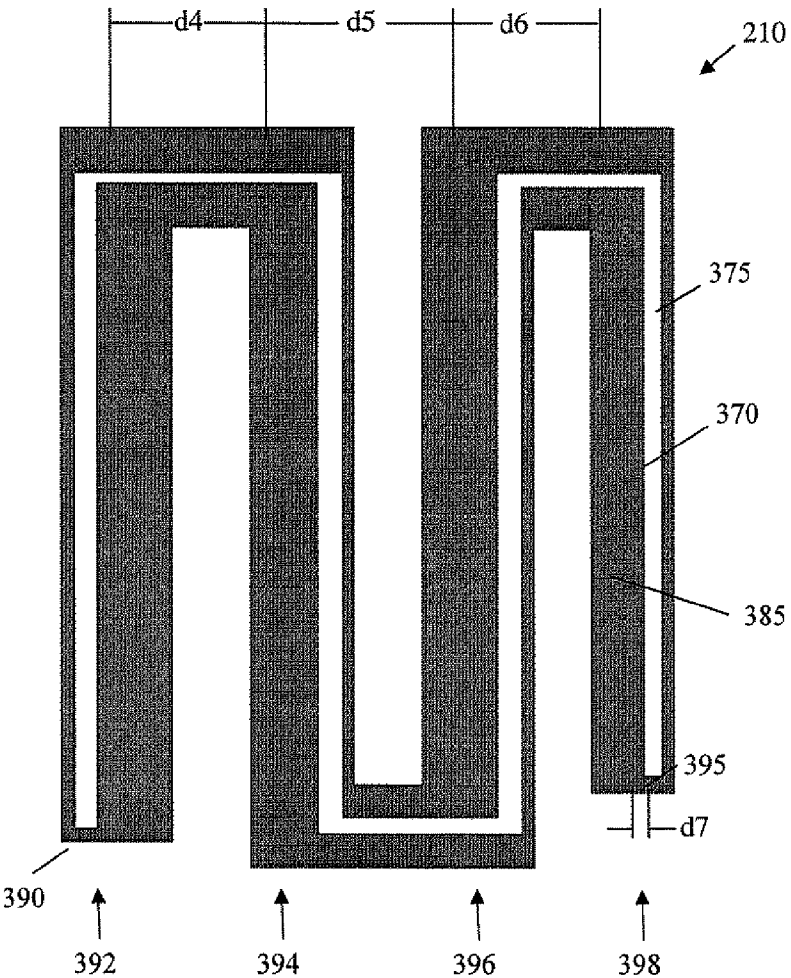
FIG. 3B schematically illustrates a view of a general structure of radiating layer of a dual polarized dipole wearable antenna according to embodiments of the present invention.
Figure 3A:
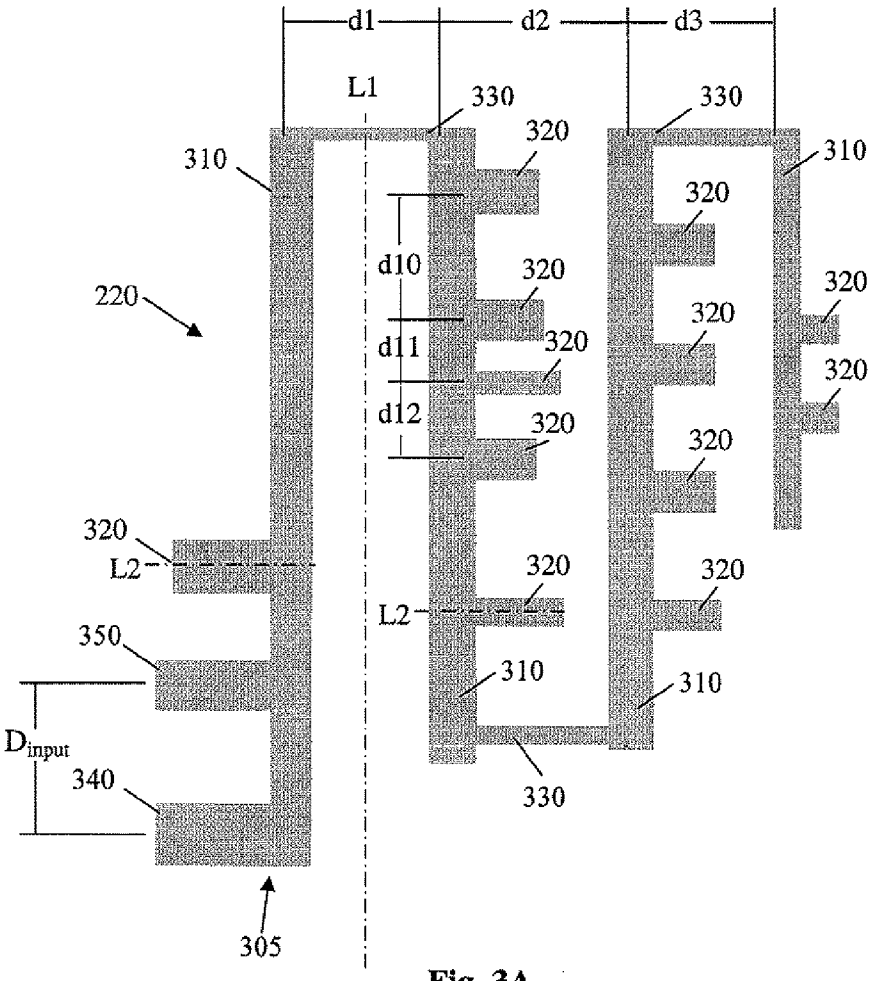
FIG. 3A schematically illustrates a view of a general structure of feed network layer of a dual polarized dipole wearable antenna according to embodiments of the present invention.

Reference is now made to FIG. 3A which schematically illustrates a top view of a general structure of feed network layer 220 of a dual polarized dipole wearable antenna 325 according to some embodiments of the present invention. Feed network layer 220 may receive and transmit signals polarized in a direction which is generally parallel to longitudinal axis L1, (horizontally polarized signals). Feed network layer 220 comprises a main stripe 305 comprising a plurality of substantially straight sections 310 parallel to each other and to axis L1, with a plurality of stubs 320 protruding from sections 310, having each a stub's imaginary longitudinal axis L2 substantially orthogonal to axis L1. Longitudinal stripes 310 may be connected to each other via substantially right angled bands 330, thus creating continuous stripe 305. Stubs 320 may generally take the form of a rectangle of various dimensions. Stubs 320 may be of a size 3-2 mm long by 1-2 mm wide to match the antenna at frequency range of 435±10 MHz. The distances d1, d2, d3 between every two adjacent sections 310 may be substantially 0.02λ. Stubs 320 may be disposed in equal or non equal distances d10, d11, d12 etc. between every two adjacent stubs 320 along longitudinal stripe sections 310. Stubs of other geometrical forms may also be suitable. Two input/output stubs 340 and 350 may serve as energy input/output terminals. Input/output stubs 340 and 350, may be at a distance of for example, 0.02λ from each other. It would be apparent that the schematic illustration of feed network layer 220 in FIG. 3A illustrates a general structure of feed network layer 220 and other embodiments of the current invention may include more or less stubs. Further, the stubs dimensions, form and location along stripes 310 may vary as needed, for example in order to control the central working frequency, the bandwidth, the spatial radiation characteristics, impedance match to the body of the user, etc., of antenna 325. According to some embodiments of the invention, the total length of strip 305 may be, for example, around 175 mm, which is approximately one quarter of the central wavelength 700 mm. Alternatively, strip 305 may be longer or shorter, thus tuning the antenna to other center frequencies and to improve antenna matching.

Reference is now made to FIG. 3B which schematically illustrates a top view of a general structure of radiating layer 210 according to some embodiments of the present invention. Radiating layer 210 may substantially take the form of two continuous and parallel strips 375 and 385 banded at right angles to form a plurality of sections 392, 394, 396, 398 substantially parallel to each other and distanced at distances d4, d5, d6 (respectively) from each other. Strips 375, 385 may have there between a slot or a gap 370 extending along each of sections 392, 394, 396 and 398 and along the connecting elements of these sections. Strips 375, 385 may be connected to each other at the end points 390, 395. Rectangular slot or gap 370 may generally take the form of a narrow bended long strip having typically a width d7. Radiating layer 210 generally follows the general shape of bended main stripe 305 so that when layers 210 and 220 are properly placed adjacent to each other sections 392, 394, 396 and 398 are positioned substantially against elements 310, as is explained with respect to FIG. 3C. The width d7 of slot or gap 370 may typically be 2 mm.

Figure 3C:
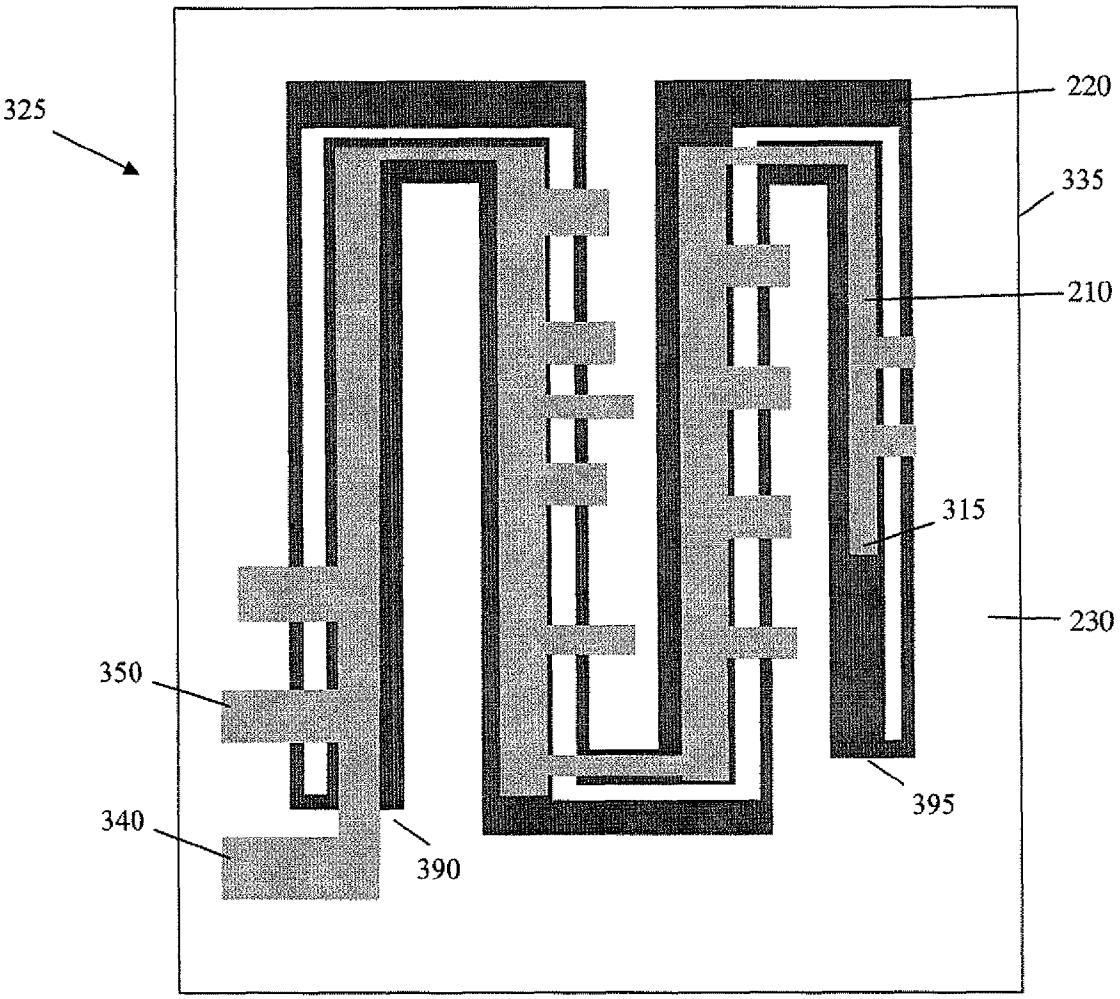
FIG. 3C schematically illustrates a view of a general structure of a dual polarized dipole wearable antenna comprising a radiating layer on top of a feed network layer and a ground layer according to embodiments of the present invention.

Reference is now made to FIG. 3C which schematically illustrates a top view of a general structure of an antenna 325 with radiating layer 210 on top of feed network layer 220 and GND layer 230 according to some embodiments of the present invention. While in antenna according to embodiments of the present invention radiating layer 210 is positioned on top of feed network layer 220, in the illustration of FIG. 3C feed network layer 220 is plotted on top of radiating layer 210. This is done for better clarity of demonstration of inter-placement relations of these layers. Dielectric substrate layers 240 and 250 and ground layer 230 may take the form of a substantially full continuous plate extending beyond the outermost dimensions of radiating layer 210 and feed network layer 220. For example, ground layer 230 may take the form of rectangle 335. When placed one on top of the other, parallel strips 375 and 385 are disposed against longitudinal strip 310 of feed network layer 220, and stubs 320 of feed network layer 220 are disposed across the gap formed by slot 370 of radiating layer 210. Typically, a first edge 390 of radiating layer 210 is disposed between input/output stubs 340 and 350 and the second edge 395 extends beyond the second edge 315 of banded longitudinal stripe 310.

When radiating layer 210 is placed as described above with relation to feed network layer 220, longitudinal strip 310 may receive and transmit horizontally polarized signals, as described above. Input/output stub 340 may serve as energy input/output terminal for these horizontally polarized signals. Slot 370 of radiating layer 210 may be excited by radiation from, and be in interaction with stubs 320 of feed network layer 220 to receive and transmit vertically polarized signals, that is, signals polarized in a direction which is generally perpendicular to longitudinal axis L1. Input/output stub 350 may be disposed across from slot 370 of radiating layer 210 and may serve as energy input/output terminal for these vertically polarized signals.

Having two polarization directions may prove beneficial for receiving/transmitting signals from/to a transmitter/receiver which may change its orientation and thus its polarization with respect to antenna 140. For example, if antenna 140 is used for receiving/transmitting signals from/to a swallowable capsule, the capsule may turn as it traverses along a body lumen, such as a GI tract, changing the direction of its polarization of its antenna relatively to the wearable antenna 140 of the current invention. Wearable antenna 140 which is vertically and horizontally polarized may receive/transmit both the vertically and horizontally polarized parts of the signal, whereas vertically polarized antenna may receive/transmit only the vertically polarized parts of the signal and lose the horizontally polarized parts of the signal, and horizontally polarized antenna may receive/transmit only the horizontally polarized parts of the signal and lose the vertically polarized parts of the signal. Thus, a double polarized antenna may provide an improved overall signal to noise (SNR) ratio with comparison to a single polarized antenna.

Figure 4A:
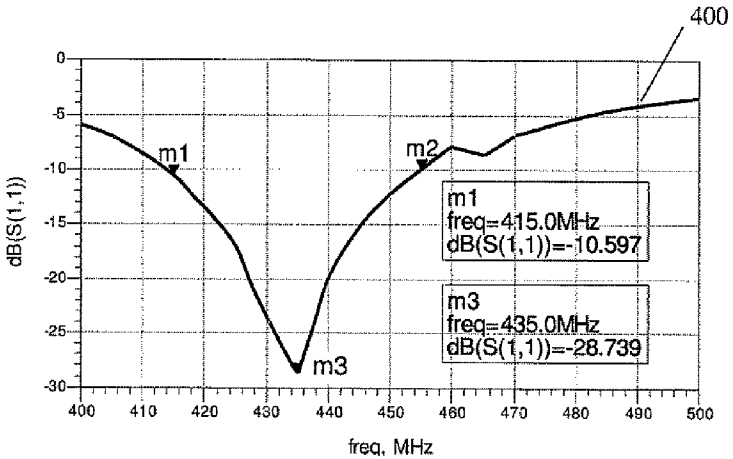
FIGS. 4A and 4B schematically plots exemplary values of S(1,1) and S(2,2) of an antenna according to embodiments of the present invention.
Figure 4B:
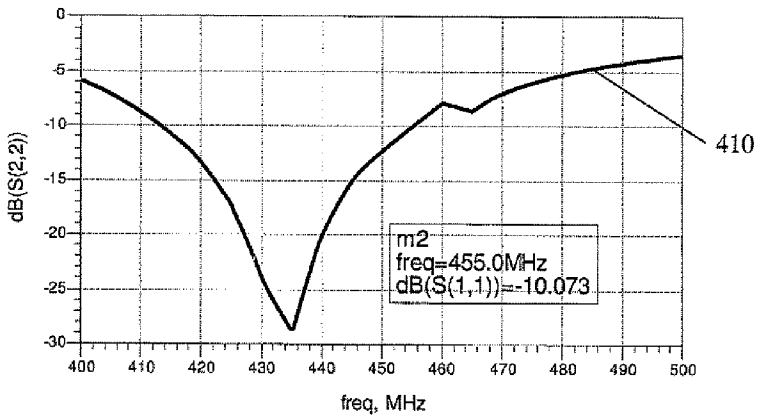

Reference is now made to FIGS. 4A and 4B which schematically plot exemplary values of the input reflection coefficient of 50Ω terminated output also denoted as S(1,1) 400 and of the output reflection coefficient of 50Ω terminated input, also denoted as S(2,2) 410 of antenna 325 in dB versus frequency of operation. Both S(1,1) 400 and S(2,2) 410 graphs show a minimal value of nearly −30 dB at around 434 MHz, which is the center frequency for which antenna 325 was designed. Additionally, it can be seen from the S(1,1) 400 graph that S(1,1) values at 415 MHz and 435 MHz equals approximately −10 dB which enables bandwidth of 40 MHz around the center frequency.

Figure 5B:
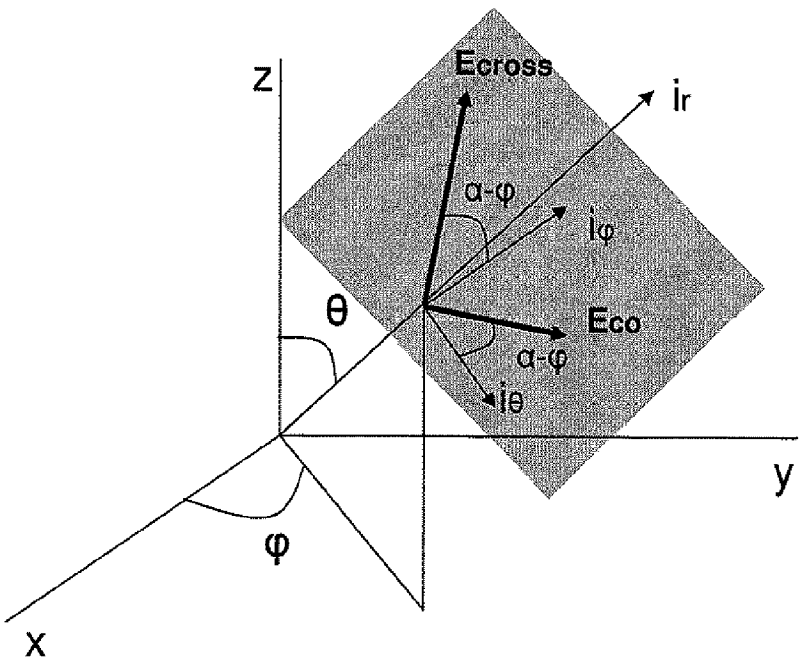
FIG. 5B schematically illustrates $\theta$, $\phi$, $i_r$, $i_\theta$, $i_\phi$ E_co and E_cross.
Figure 5A:
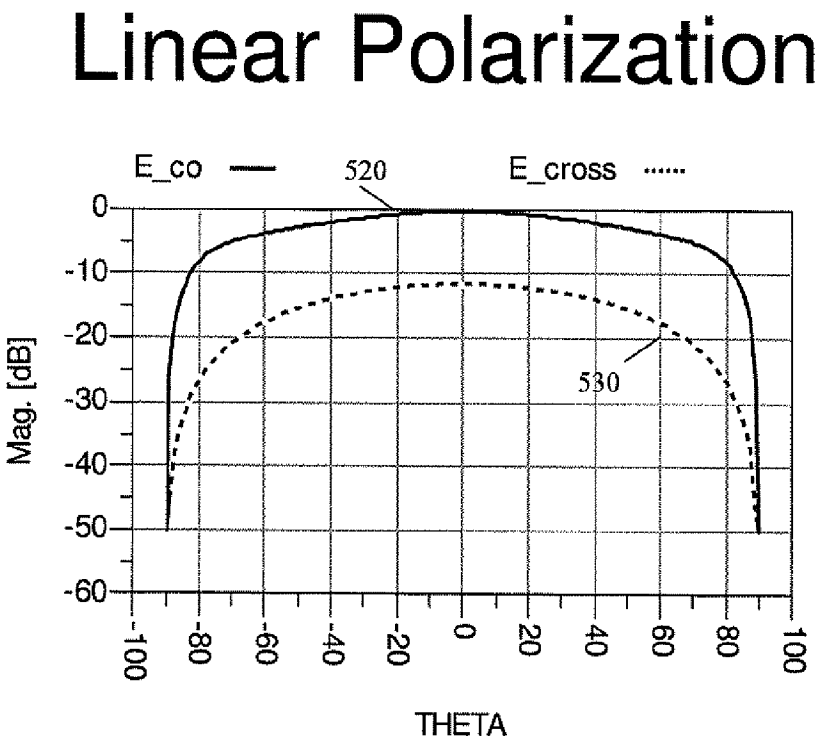
FIG. 5A schematically plots exemplary values of the Linear polarization of an antenna according to embodiments of the present invention.

Reference is now made to FIG. 5A which schematically plots exemplary values of E_co, the total linear polarized field, 520 and E_cross, the cross polarized field, 530 of antenna 325 in dB versus θ (theta). E_co and E_cross are retrieved by decomposing the far field. The equations for decomposing the far field into E_co and E_cross are given below:

$$E_{co}=E_{\theta}\cos(\alpha-\phi)+E_{\phi}\sin(\alpha-\phi) \quad \text{(Equation 1)}$$

$$E_{cross}=(-E_{\theta})\sin(\alpha-\phi)+E_{\phi}\cos(\alpha-\phi) \quad \text{(Equation 2)}$$

While α is the co-polarization angle, R, θ and ϕ are spherical coordinates, $i_r$, $i_\theta$ and $i_\phi$ are vectors in the direction of R, θ and ϕ, respectively, and $E_\theta$ and $E_\phi$ are the far field values in the direction of θ and ϕ, respectively. θ, ϕ, $i_r$, $i_\theta$, $i_\phi$ E_co and E_cross are demonstrated in FIG. 5B. The values of E_co and E_cross describe the radiation pattern of antenna 325. It can be seen that E_co is nearly flat and lies in the range of −10 to 0 dB for theta values of −80°<theta<80°. E_cross ranges from around −20 dB to −10 dB. Keeping E_co values high for −90°<theta<90° indicates that antenna 325 is nearly linearly polarized. As known in the art, a "linear polarization axial ratio" ($AR_{lp}$) can be derived from E_co and E_cross:

$$AR_{lp}=\frac{|E_{co}|+|E_{cross}|}{|E_{co}|-|E_{cross}|} \quad \text{(Equation 3)}$$

$AR_{lp}$ illustrates how well the antenna is linearly polarized. The absolute value of $AR_{lp}$ equals one when perfect linear polarization is observed and becomes infinite for a perfect circular polarized antenna. Keeping E_cross values low for −90°<Theta<90° cause the absolute value $AR_{lp}$ to be close to one, which indicates that antenna 325 is nearly linearly polarized.

Figure 6:
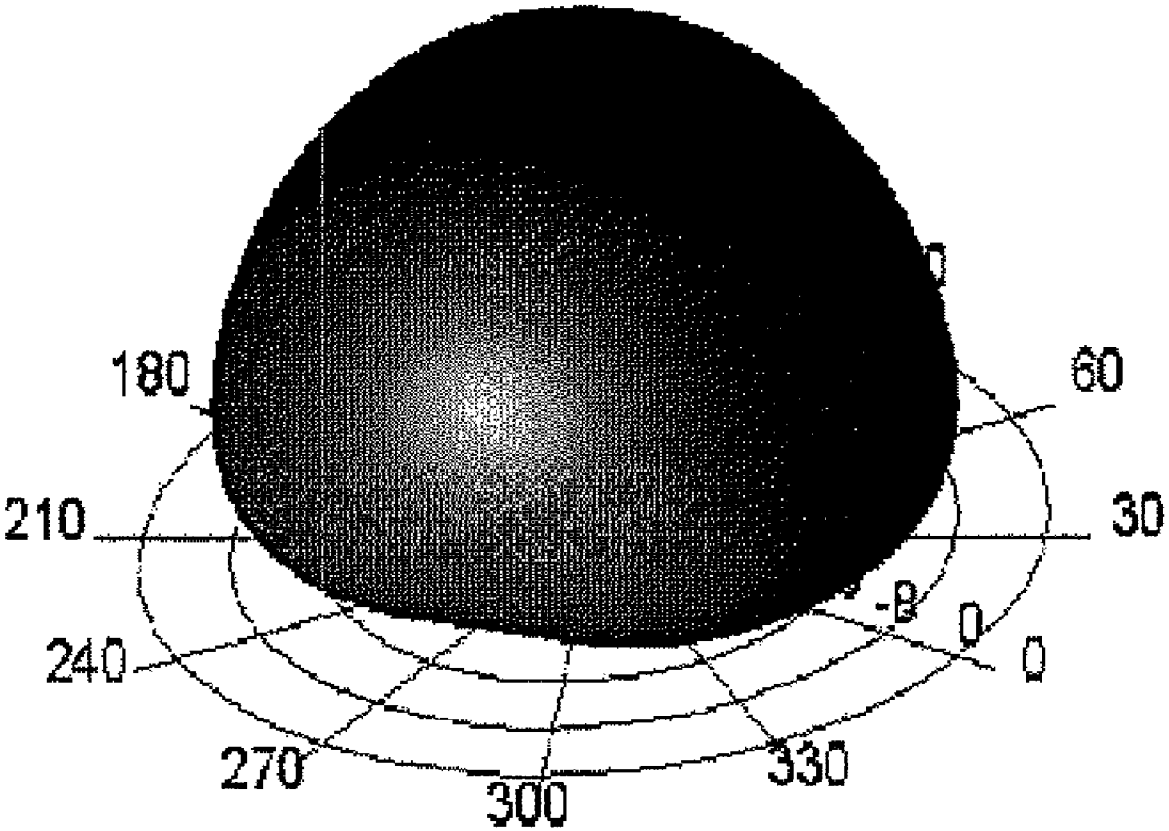
FIG. 6 schematically plots the exemplary radiation pattern of an antenna according to embodiments of the present invention.
Figure 7A:
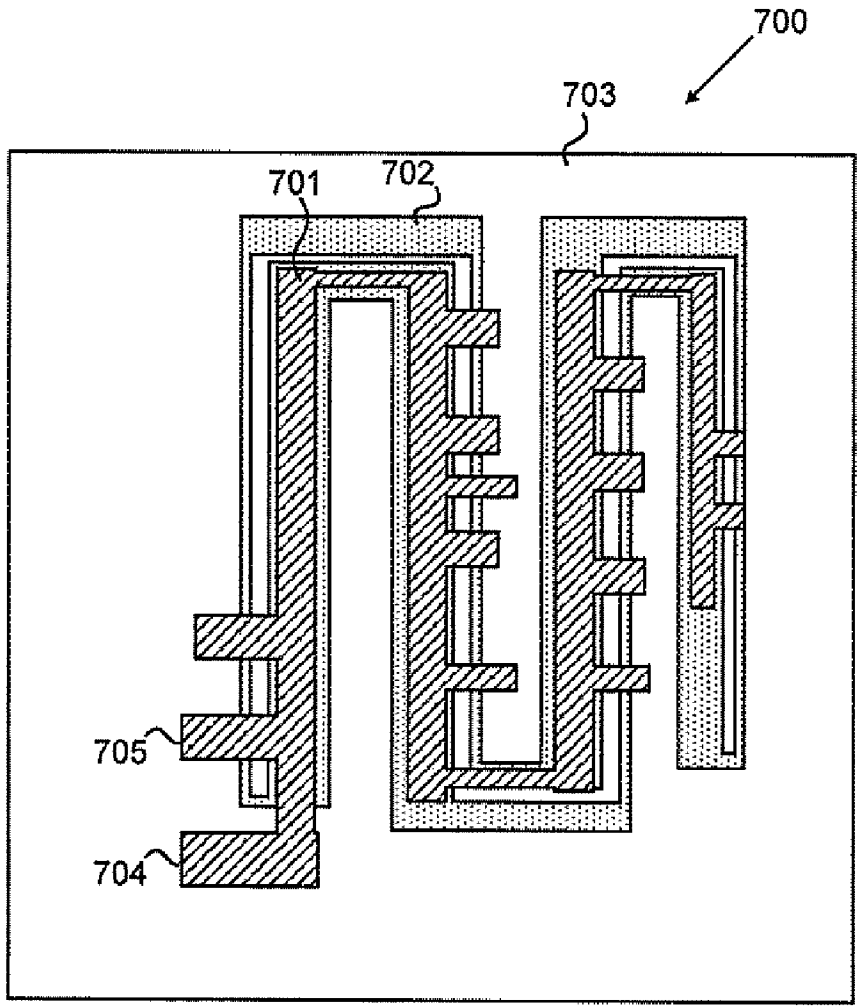
FIGS. 7A-7E schematically illustrate examples of a dual polarized dipole wearable antenna according to embodiments of the present invention.
Figure 7B:
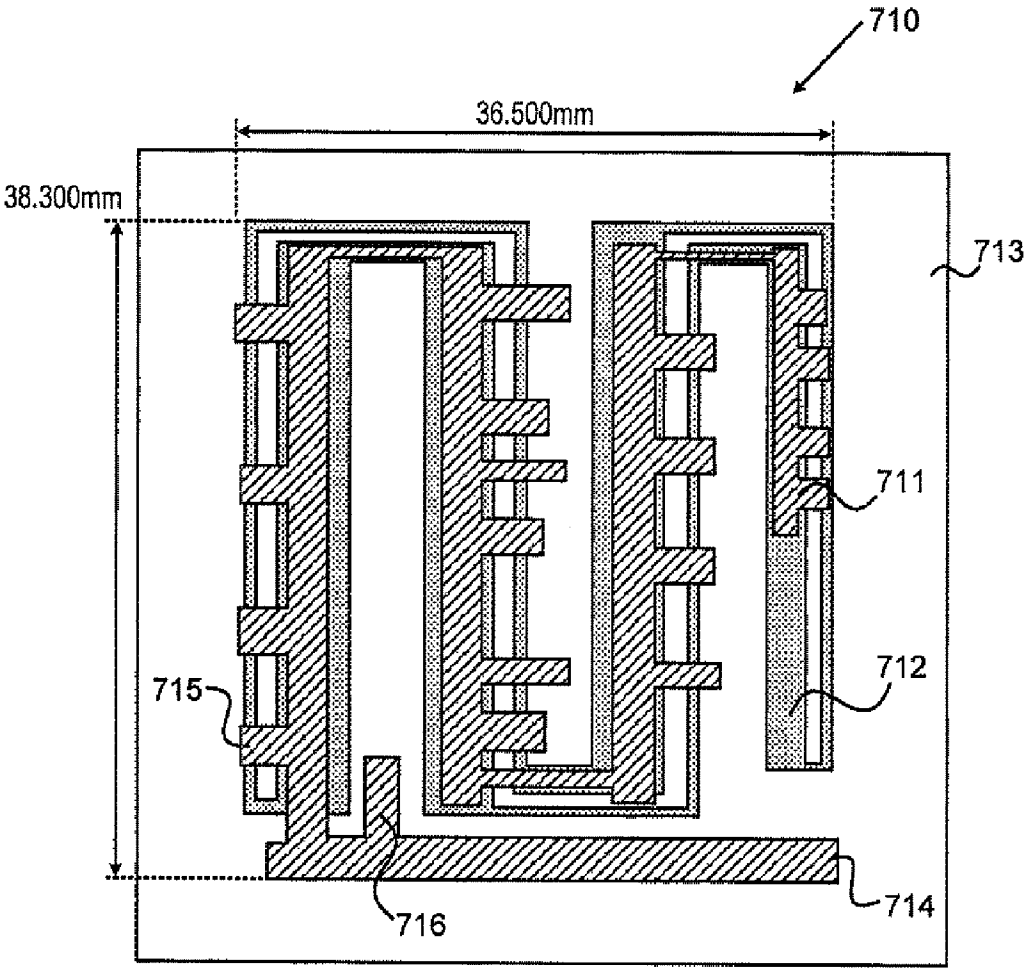
Figure 7C:
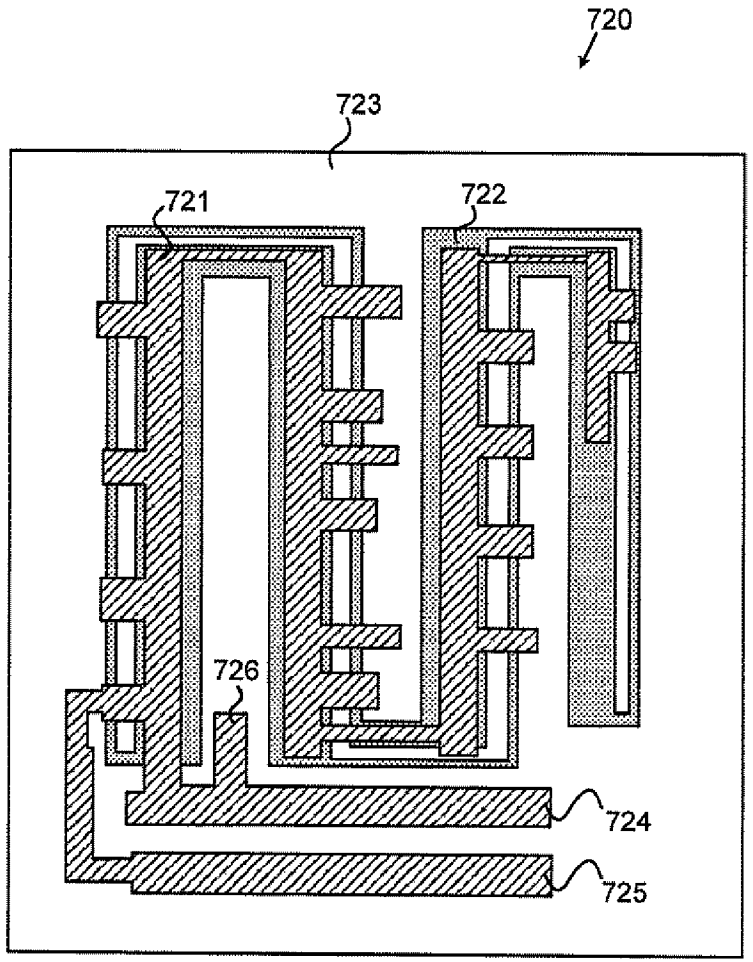
Figure 7D:
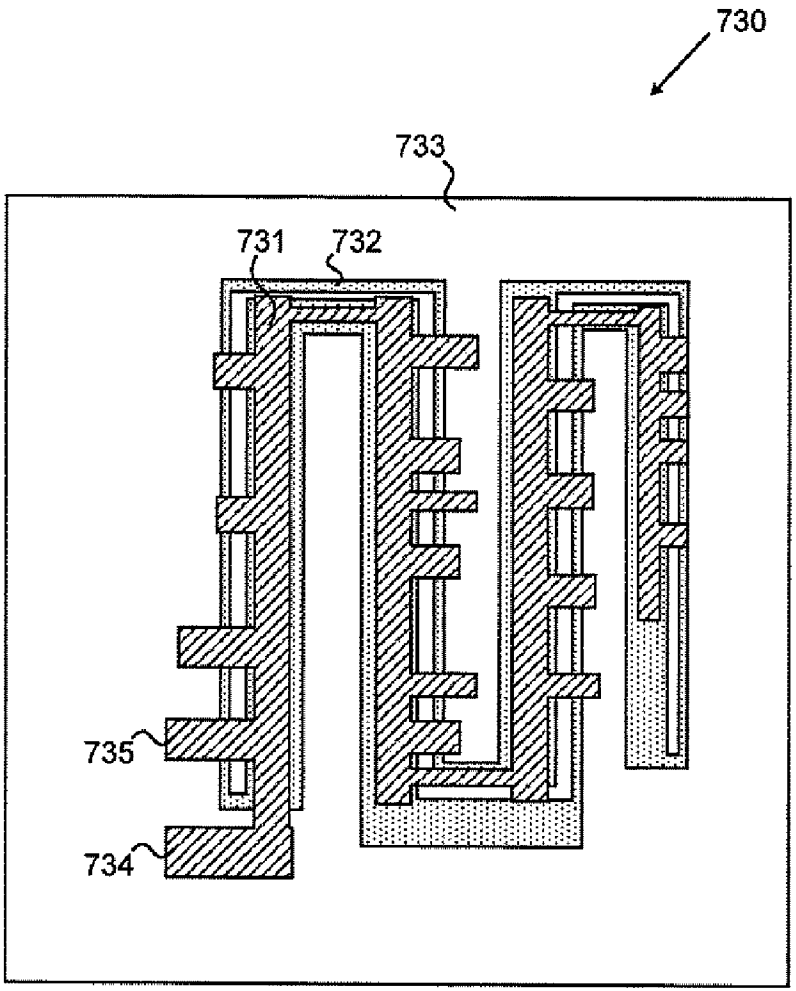
Figure 7E:
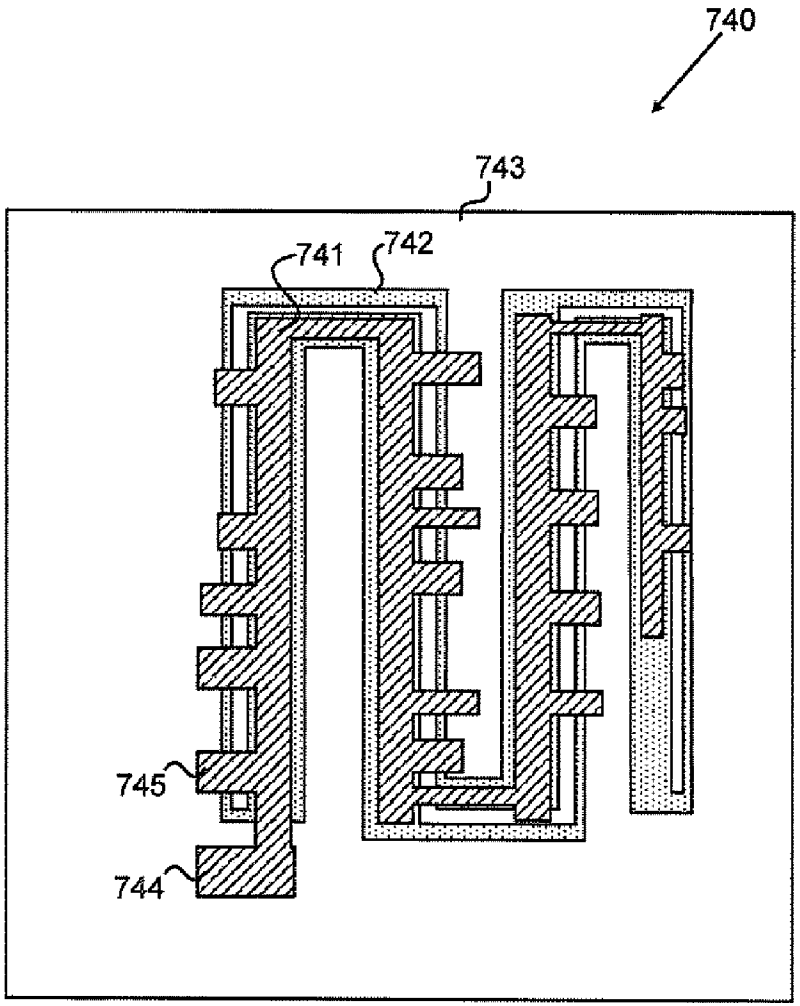

Reference is now made to FIG. 6 which schematically plots the exemplary radiation pattern of antenna 325. It can be seen that the radiation pattern of antenna 325 is hemispherical.

Data presented in FIGS. 4-6 was simulated using ADS Agilent software and assuming a simulation model of air, body, shirt (0.5-0.8 mm) antenna and air.

Reference is now made to FIGS. 7A-7E which schematically illustrate examples of a dual polarized dipole wearable antenna 700, 710, 720, 730 and 740 respectively, according to embodiments of the present invention. Antennas 700, 710, 720, 730 and 740 have layered structure, such as demonstrated with reference to FIG. 1. FIGS. 7A-7E depict feed network layers 701, 711, 721, 731 and 741, radiating layers 702, 712, 722, 732 and 742, and ground layers 703, 713, 723, 733 and 743 of antennas 700, 710, 720, 730 and 740, respectively. As was explained above with respect to FIG. 3C, feed network layers are plotted in FIGS. 7A-7E on top of radiating layers for better clarity of demonstration of inter-placement relations of these layers, while in antennas made according to respective embodiments feed network layers are placed under the radiating layers. The dielectric layers have the form of substantially rectangular full plane, similar to the ground plane and are not shown for clarity of the illustration. The dimensions of the outer limits of feed network layer 711 and radiating layer 712 of antenna 710 are given in FIG. 713 to be, for example, around 36.5 mm long and 38.3 mm wide. The total dimensions of the antenna, including the ground plane may be, for example, around 40 mm long, 37 mm wide and 0.5 mm thick. Other embodiments of the current invention may have other dimensions. As described above with reference to FIG. 3A antennas 700, 710, 720, 730 and 740 each has two input/output stubs serving as two input/output terminals. First input/output terminal 704, 714, 724, 734 and 744 of each antenna 700, 710, 720, 730 and 740, respectively may receive and transmit substantially horizontally polarized signals. A second input/output terminal 705, 715, 725, 735 and 745 for each antenna, 700, 710, 720, 730 and 740, respectively, may receive and transmit vertically polarized signals. Feed network layers 701, 711, 721, 731 and 741 may be variations of the general structure of feed network layer 220 as described with reference to FIG. 3A. Radiating layers 702, 712, 722, 732 and 742 may be variations of the general structure of radiating layer 210 as described with reference to FIG. 3B. in can be seen in examples 710 and 720 that the input/output ports may be longer than demonstrated in the general structure 325 and have a network of matching stubs comprising one or more matching stubs 716, 726.

Figure 8B:
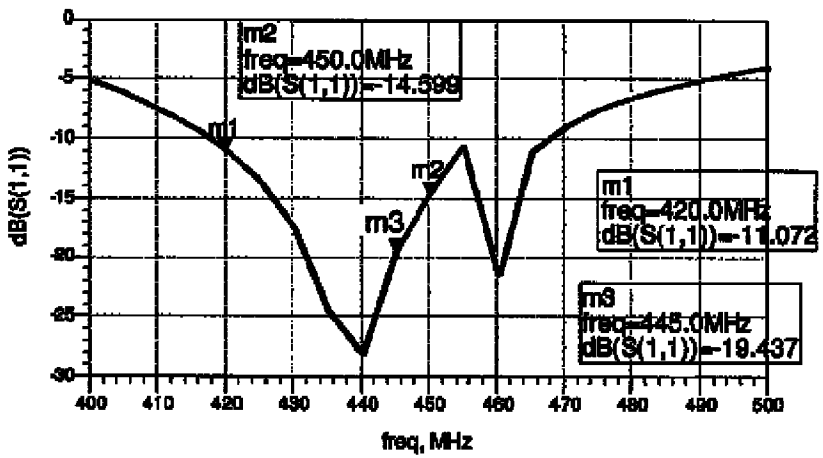
FIGS. 8B and 8C schematically plot exemplary values of S(1,1) of two other antennas, respectively according to embodiments of the present invention.
Figure 8C:
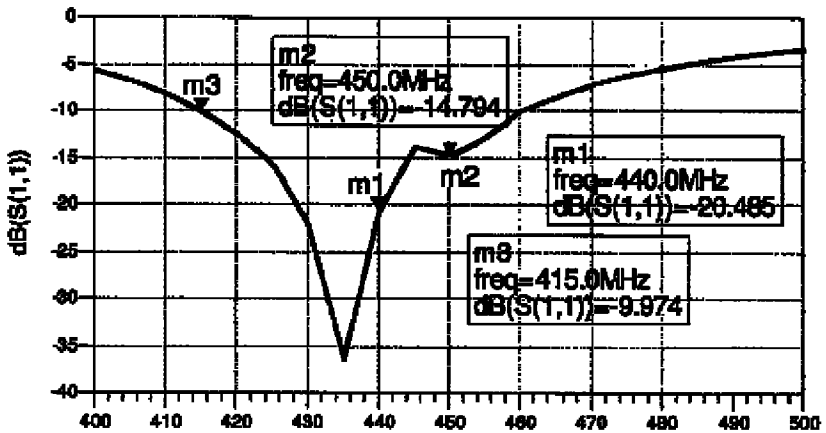
Figure 8D:
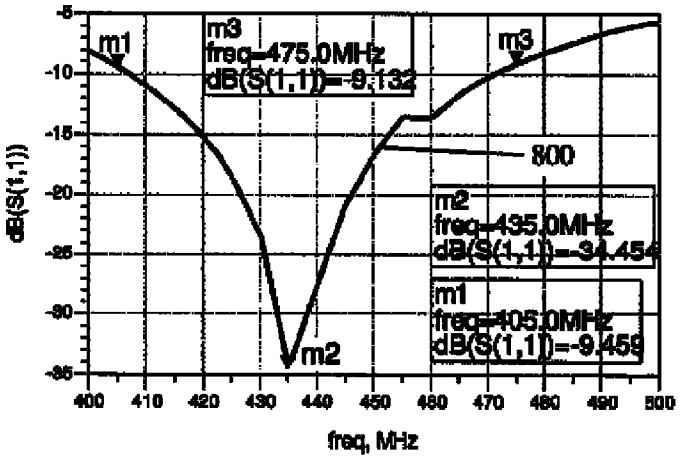
FIGS. 8D and 8A schematically plots exemplary values of S(1,1) and S(2,2) of another antenna according to embodiments of the present invention.
Figure 8A:
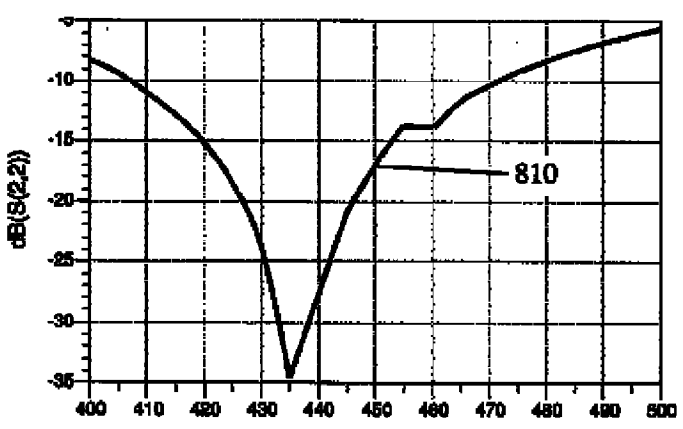

Reference is now made to FIGS. 8D and 8A which schematically plots exemplary values of S(1,1) 800 and of S(2,2) 810 of antenna 710 in dB versus frequency of operation. Both S(1,1) 800 and S(2,2) 810 graphs show a minimal value (m2 in S(1,1)) of nearly −35 dB at around 435 MHz, which is the center frequency for which antenna 710 was designed. Additionally, it can be seen from the S(1,1) 800 graph that S(1,1) values at 405 MHz (marked m1) and at 475 MHz (marked m3) equals approximately −10 dB which enables bandwidth of 70 MHz around the center frequency. FIGS. 8B and 8C schematically plots exemplary values of S(1,1) of antennas 730 and 740, respectively. The values of E_co and E_cross and the radiation pattern of antennas 700, 710, 720, 730 and 740 are very similar to the values presented in FIGS. 5 and 6 and therefore are not shown.

Figure 9:
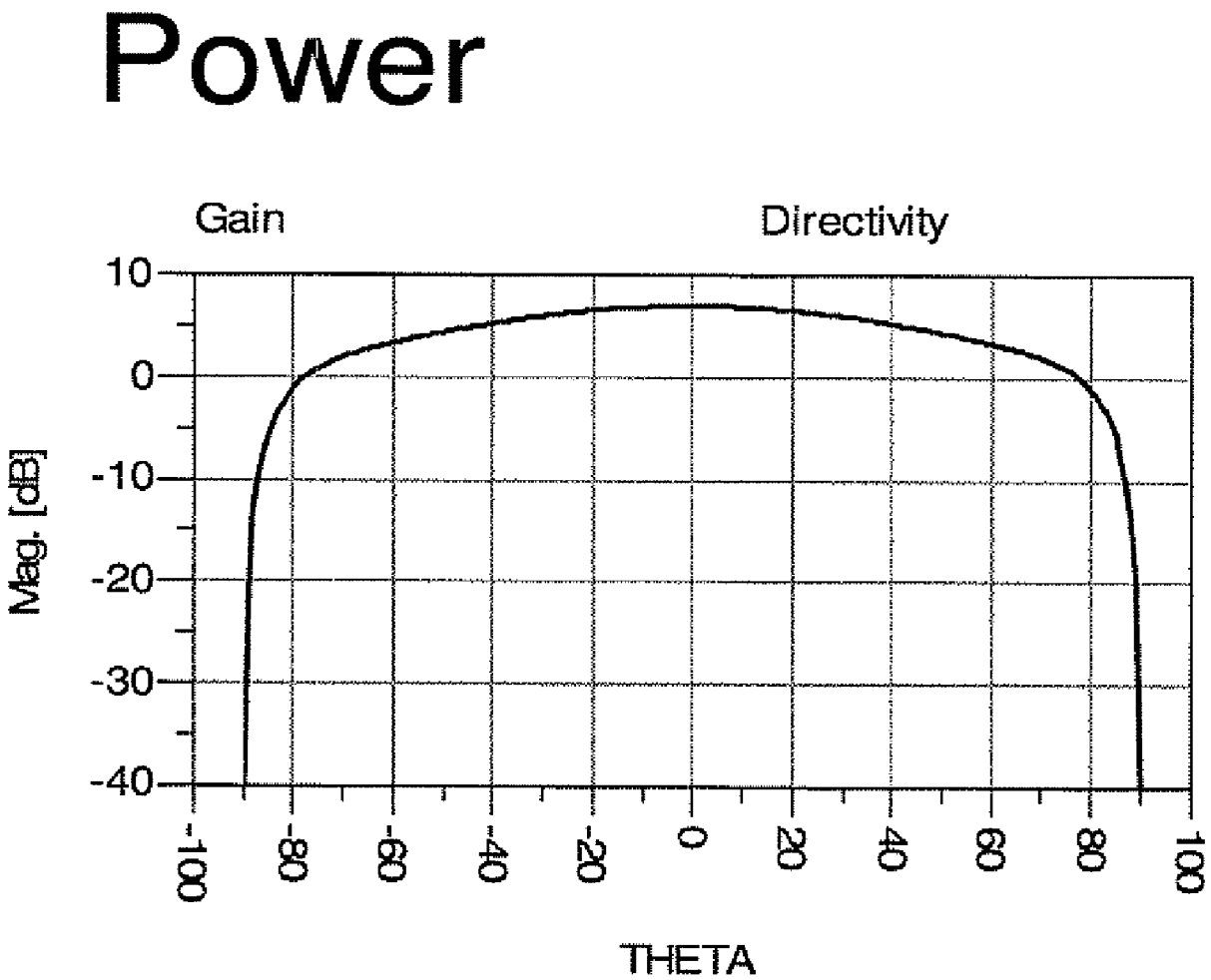
FIG. 9 schematically plots exemplary values of the gain of another antenna according to embodiments of the present invention.

Reference is now made to FIG. 9 which schematically plots exemplary values of the gain versus Theta of antenna 730. It can be seen that antenna 730 has positive gain of about 5 dB for −80°<Theta<80°.

According to some embodiments of the invention, a single antenna of the current invention can be used. However, for coverage of larger areas in the human torso, or for other purposes, two or more antennas may be used together. For example, two or more dual polarized dipole wearable antennas may be used, forming an array of antennas. For example, two or more dual polarized dipole wearable antennas may be embedded into a shirt or an outfit to cover larger areas of the torso. Alternatively, other combinations may be used.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. A wearable antenna comprising:

a first dielectric substrate layer;

a second dielectric substrate layer;

a conductive feed network layer formed on the inner sides of said first and said second dielectric substrate layers, said feed network layer comprising a main stripe, comprising a plurality of substantially straight sections parallel to each other and connected to each other via substantially right angled bands with substantially orthogonal stubs protruding from said sections;

a conductive radiating layer formed on the outer side of said first dielectric substrate layer, said radiating layer comprising two continuous and parallel stripes banded at right angles to form a plurality of substantially parallel sections said stripes having there between a rectangular slot, wherein said radiating layer is disposed along said main stripe of said feed network layer; and a conductive ground layer formed on the outer side of said second dielectric substrate layer, said ground layer extending beyond the outermost dimensions of said feed network layer and said radiating layer, wherein said stubs of said feed network layer are disposed across from said slot of said radiating layer such that said antenna is capable of receiving and transmitting both substantially vertically and substantially horizontally polarized signals.

2. The wearable antenna of claim 1, wherein the relative permittivity of said first and second dielectric substrate layers is in the range of 2 to 10.

3. The wearable antenna of claim 1, wherein the relative permittivity of said first dielectric substrate layer is higher than said second dielectric substrate layer.

4. The wearable antenna of claim 1, wherein the resonance frequency is in the range of 434±20 MHz, the center wavelength is in the range of 63 to 73 cm and the bandwidth is at least 20 MHz.

5. The wearable antenna of claim 1, wherein the thickness of said first dielectric substrate layer is in the range of 0.2-1.6 mm and the thickness of said second dielectric substrate layer is in the range of 0.2-1.6 mm.

6. The wearable antenna of claim 1, wherein the total length of said main stripe is substantially ¼ of the central wavelength.

7. The wearable antenna of claim 1, wherein said stubs are in the form of a rectangle.

8. The wearable antenna of claim 1, wherein said conductive feed network layer further comprises:

a first input/output stub, disposed across from said slot of said radiating layer, to serve as an energy input/output terminal for vertically polarized signals; and a second input/output stub to serve as an energy input/output terminal for horizontally polarized signals.

9. The wearable antenna of claim 8, wherein said input/output stubs comprise matching networks.

10. The wearable antenna of claim 1, wherein said ground layer is in the form of a rectangle.

11. The wearable antenna of claim 1, wherein said stripes are connected to each other at the end points of said stripes.

12. The wearable antenna of claim 1, wherein said antenna is used to receive and transmit signals to and from an ingestible capsule.

* * * * *